US009195176B2

(12) United States Patent
Seki et al.

(10) Patent No.: US 9,195,176 B2
(45) Date of Patent: Nov. 24, 2015

(54) IMAGE FORMING APPARATUS

(71) Applicant: CANON KABUSHIKI KAISHA, Tokyo (JP)

(72) Inventors: Hiroyuki Seki, Numazu (JP); Takaaki Tsuruya, Mishima (JP); Taku Kanai, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/559,132

(22) Filed: Dec. 3, 2014

(65) Prior Publication Data

US 2015/0177653 A1 Jun. 25, 2015

(30) Foreign Application Priority Data

Dec. 25, 2013 (JP) ..... 2013-267858

(51) Int. Cl.
*G03G 15/16* (2006.01)

(52) U.S. Cl.
CPC ..... *G03G 15/161* (2013.01)

(58) Field of Classification Search
CPC ..... G03G 15/162; G03G 15/161; G03G 15/0121; G03G 15/0152; G03G 15/0194; G03G 15/751; G03G 21/0017; G03G 21/0064; G03G 2215/0129; G03G 2215/017; G03G 2215/1623; G03G 15/1605; G03G 2215/0132
See application file for complete search history.

(56) References Cited

U.S. PATENT DOCUMENTS

| | | | | |
|---|---|---|---|---|
| 6,078,775 | A * | 6/2000 | Arai et al. | 399/308 |
| 6,643,487 | B1 * | 11/2003 | Shimmura | 399/302 |
| 8,190,052 | B2 * | 5/2012 | Tanaka | 399/101 |
| 2007/0237553 | A1 * | 10/2007 | Namba | 399/302 |
| 2010/0316420 | A1 * | 12/2010 | Mori | 399/302 |
| 2013/0051838 | A1 * | 2/2013 | Takazawa | 399/101 |
| 2014/0169813 | A1 | 6/2014 | Seki et al. | |

FOREIGN PATENT DOCUMENTS

| | | | |
|---|---|---|---|
| JP | 2003-330229 | A | 11/2003 |
| JP | 2004-240176 | A | 8/2004 |
| JP | 2005-82327 | A | 3/2005 |
| JP | 2006-106325 | A | 4/2006 |
| JP | 2009-75154 | A | 4/2009 |
| JP | 2012-42656 | A | 3/2012 |
| JP | 2013-68733 | A | 4/2013 |

* cited by examiner

*Primary Examiner* — Francis Gray
(74) *Attorney, Agent, or Firm* — Fitzpatrick, Cella, Harper & Scinto

(57) ABSTRACT

An image forming apparatus includes: an image bearing member for bearing a toner image; a movable intermediary transfer member onto which the toner image is to be transferred from the image bearing member; and a cleaning member, contacting a surface of the intermediary transfer member, for scraping off a toner from the surface of the intermediary transfer member which moves. At the surface of the intermediary transfer member, a plurality of grooves are formed along a surface movement direction of the intermediary transfer member. The surface of the intermediary transfer member has an average in-plane roughness of 10 nm or more and 30 nm or less in an area of a square of an average particle size of the toner.

15 Claims, 6 Drawing Sheets

(a)

(b)

IMAGE FORMING APPARATUS

FIELD OF THE INVENTION AND RELATED ART

The present invention relates to an image forming apparatus such as a laser printer, a copying machine or a facsimile machine.

As a conventional image forming apparatus using, e.g., an electrophotographic type, there is an image forming apparatus of an intermediary transfer type using an intermediary transfer member.

In the image forming apparatus of the intermediary transfer type, a toner image formed on a photosensitive member is primary-transferred onto the intermediary transfer member and then is secondary-transferred from the intermediary transfer member onto a transfer(-receiving) material. As the intermediary transfer member, an intermediary transfer belt formed with an endless belt has been used widely.

In the image forming apparatus of the intermediary transfer type, a toner (secondary transfer residual toner) remains on the intermediary transfer belt after a secondary transfer step. For that reason, there is a need to provide a cleaning step of removing the secondary transfer residual toner remaining on the intermediary transfer belt before a subsequent toner image is transferred onto the intermediary transfer belt.

As a type in which the secondary transfer residual toner on the intermediary transfer belt is removed, a blade cleaning type has been widely used. In the blade cleaning type, the secondary transfer residual toner is physically collected from a moving intermediary transfer belt by a cleaning blade as a cleaning member provided downstream of a secondary transfer portion with respect to a surface movement direction of the intermediary transfer belt (hereinafter referred to as a belt feeding direction). As the cleaning blade, an elastic material such as an urethane rubber is used in general. In many cases, an edge portion of this cleaning blade is press-contacted to the intermediary transfer belt from a direction of opposing a rotational direction of the intermediary transfer belt.

On the other hand, in order to further improve an image quality, improvement in transfer efficiency when the toner image is transferred from the intermediary transfer belt onto the transfer material has been required. In Japanese Laid-Open Patent Application (JP-A) 2009-75154, an intermediary transfer belt in which power (hereinafter also referred to as a filler) smaller in diameter than a particle size of the toner is buried in the surface of the intermediary transfer belt to modify a physical property of the surface of the intermediary transfer belt so that the toner does not readily remain on the belt has been proposed. Further, in JP-A 2004-240176, an intermediary transfer belt in which a surface roughness thereof is defined and thus the toner does not readily remain on the belt has been proposed.

In the blade cleaning type, there is a need to satisfy a durable performance in repetitive use.

However, a method in which the filler is added into the surface of the intermediary transfer belt described in JP-A 2009-75154 involves a problem in terms of cleaning blade wearing in repetitive use. In the case where projected-shape portions by the filler are distributed over the surface of the intermediary transfer belt, exposed ends of the projected-shape portions selectively contact an edge portion of the cleaning blade, and therefore by the repetitive use, the edge portion of the cleaning blade starts to wear out gradually from contact points with the projected-shape portions. As a result, the edge portion of the cleaning blade non-uniformly wears out or becomes chipped, so that there is a liability that the toner slips through the cleaning blade from the chipped portion as a starting point and thus defective cleaning (improper cleaning) occurs. Particularly, when a particle size of the filler is large, the projected-shape portions become large, and therefore the wearing and the chipping are more liable to advance.

Further, as described in JP-A 2004-240176, also by defining a surface roughness value of the intermediary transfer belt, the surface of the intermediary transfer belt has a projected shape, and therefore depending on setting of the surface roughness value, similarly as in the case of the intermediary transfer belt in JP-A 2009-75154, there is a liability that a wearing (abrasion) amount of the edge portion of the cleaning blade increases.

As described above, in the conventional blade cleaning type, there is a problem such that realization of a long lifetime of the apparatus by a decrease in wearing amount of the cleaning blade in long-term use while improvement transfer efficiency is required.

SUMMARY OF THE INVENTION

A principal object of the present invention is to provide an image forming apparatus capable of realizing suppression of wearing of a cleaning member while realizing improvement in transfer efficiency of a toner image from an intermediary transfer member onto a transfer material.

According to an aspect of the present invention, there is provided an image forming apparatus comprising: an image bearing member for bearing a toner image; a movable intermediary transfer member onto which the toner image is to be transferred from the image bearing member; and a cleaning member, contacting a surface of the intermediary transfer member, for scraping off a toner from the surface of the intermediary transfer member which moves, wherein at the surface of the intermediary transfer member, a plurality of grooves are formed along a surface movement direction of the intermediary transfer member, and wherein the surface of the intermediary transfer member has an average in-plane roughness of 10 nm or more and 30 nm or less in an area of a square of an average particle size of the toner.

These and other objects, features and advantages of the present invention will become more apparent upon a consideration of the following description of the preferred embodiments of the present invention taken in conjunction with the accompanying drawings.

DESCRIPTION OF THE EMBODIMENTS

An image forming apparatus according to the present invention will be specifically described with reference to the drawings.

First Embodiment

1. General Structure and Operation of Image Forming Apparatus

Figure 1:
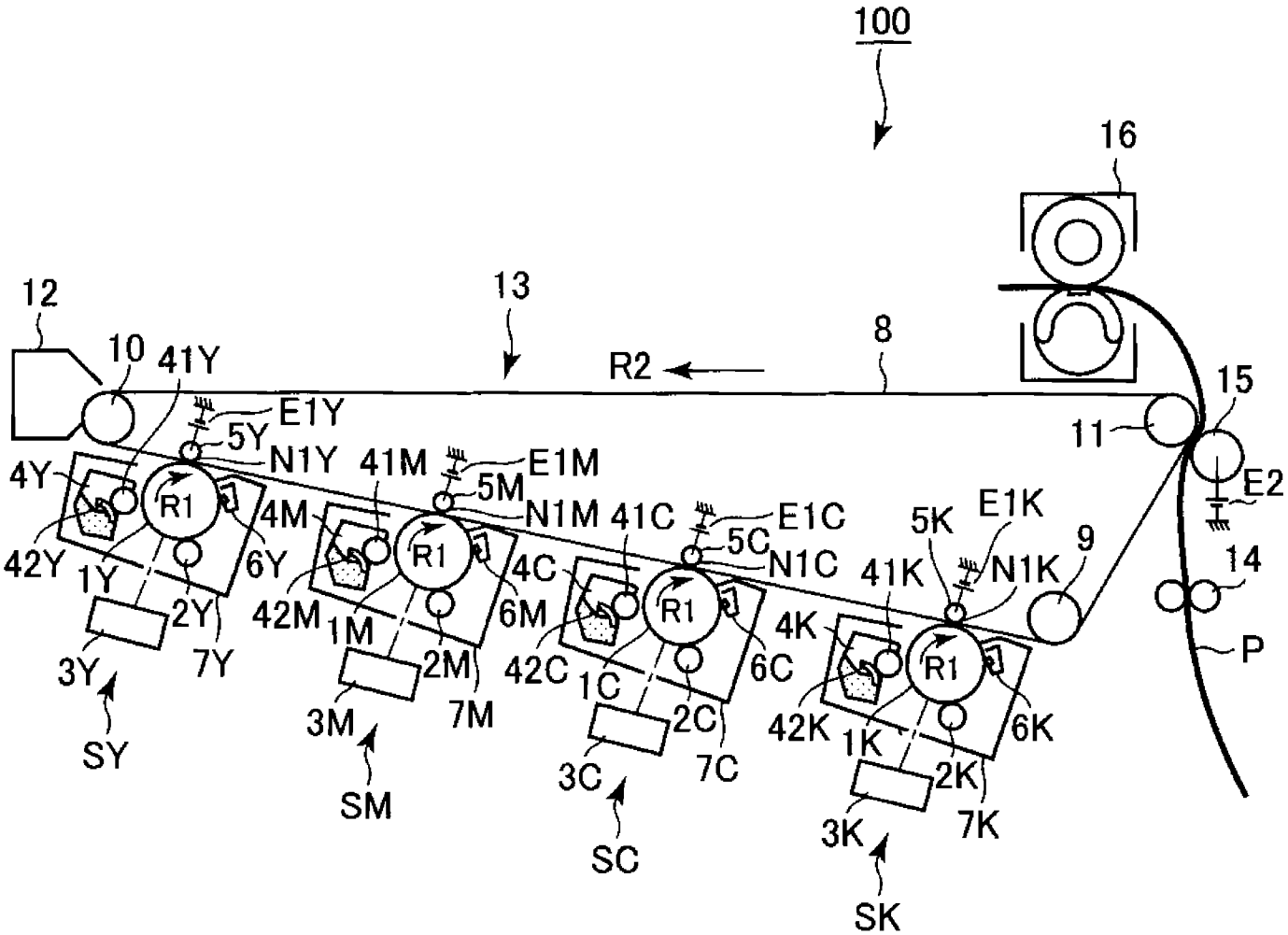
FIG. 1 is a schematic sectional view of an example of an image forming apparatus.

FIG. 1 is a schematic sectional view showing a schematic structure of an image forming apparatus 100 according to this embodiment. The image forming apparatus 100 in this embodiment is a tandem-type laser beam printer employing an intermediary transfer type and capable of forming a full-color image by using an electrophotographic type.

The image forming apparatus 100 includes for image forming portions (stations) SY, SM, SC and SK which are disposed in line with certain intervals. The image forming portions SY, SM, SC and SK form images of colors of yellow (Y), magenta (M), cyan (C) and black (Y), respectively.

In this embodiment, constitutions and operations of the image forming portions SY, SM, SC and SK are substantially the same except that the colors of toners used are different from each other. Accordingly, in the following, in the case where the image forming portions are particularly distinguished from each other, suffixes Y, M, C and K showing elements for associated colors are omitted, and these elements will be collectively described.

The image forming portion S includes a photosensitive drum 1 which is a drum-type electrophotographic photosensitive member as an image bearing member. This photosensitive drum 1 is an OPC photosensitive drum and is rotationally driven in an arrow R1 direction in FIG. 1. At a periphery of the photosensitive drum 1, the following devices are provided in a listed order. First, a charging roller 2 which is a roller-shaped charging member as a charging device is disposed. Next, an exposure device 3 is disposed. Next, a developing device 4 is disposed. Next, a primary transfer roller 5 which is a roller-shaped primary transfer member as a primary transfer device is disposed. Next, a drum cleaning device 6 as an image bearing member cleaning device is disposed.

The developing device 4 accommodates a non-magnetic one-component developer as a developer, and includes a developing sleeve 41 as a developer carrying member and a developer application blade 42 as a developer regulating device, and the like. At each of the image forming portions S, the photosensitive drum 1 and process devices, actable on the photosensitive drum 1, consisting of the charging roller 2, the developing device 4 and the drum cleaning device 6 are integrally assembled into a unit to constitute a process cartridge 7 detachably mountable to a main assembly of the image forming apparatus 100. Further, the exposure device 3 is constituted by a scanner unit by which the surface of the photosensitive drum 1 is scanned with laser light through a polygonal mirror, and thus the surface of the photosensitive drum 1 is irradiated with a scanning beam modulated on the basis of an image signal.

An intermediary transfer belt 8 constituted by an endless belt as a movable intermediary transfer member is provided so as to contact all of the photosensitive drums 1Y, 1M, 1C and 1K of the image forming portions SY, SM, SC and SK. The intermediary transfer belt 8 is supported by three rollers (stretching rollers) consisting of a driving roller 9, a tension roller 10 and a secondary transfer opposite roller 11, so that a predetermined tension is maintained. Further, the driving roller 9 is rotationally driven, whereby the intermediary transfer belt 8 is moved (rotated) in an arrow R2 direction in FIG. 1. In this embodiment, at an opposing portion to the photosensitive drum 1, the intermediary transfer belt 8 moves in the same direction as the photosensitive drum 1 substantially at the same speed as the photosensitive drum 1. In an inner peripheral surface side of the intermediary transfer belt 8, at positions opposing the photosensitive drums 1, the above-described primary transfer rollers 5 are disposed, respectively. Each of the primary transfer rollers 5 is urged (pressed) against the intermediary transfer belt 8 toward the photosensitive drum 1 at predetermined pressure, so that a primary transfer portion (primary transfer nip) N1 where the intermediary transfer belt 8 and the photosensitive drum 1 contact each other is formed. Further, in an outer peripheral surface side of the intermediary transfer belt 8, at an opposing position to the secondary transfer opposite roller 11, a secondary transfer roller 15 which is a roller-shaped secondary transfer member as a secondary transfer device is provided. The secondary transfer roller 15 is urged (pressed) against the intermediary transfer belt 8 toward the secondary transfer opposite roller 11, so that a secondary transfer portion (secondary transfer nip) N2 where the intermediary transfer belt 8 and the secondary transfer roller 15 contact each other is formed. Further, in the outer peripheral surface side of the intermediary transfer belt 8, at an opposing position to the tension roller 10, a belt cleaning unit 12 as an intermediary transfer member cleaning device is provided. The intermediary transfer belt 8 supported by the three rollers 9, 10 and 11 and the belt cleaning unit 12 are assembled into a unit to constitute an intermediary transfer belt unit 13 detachably mountable to the main assembly of the image forming apparatus 100. As a result, maintenance by a service person or an operator is facilitated.

When an image forming operation is started, each photosensitive drum 1 and the intermediary transfer belt 8 start rotation in the arrow R1 direction and the arrow R2 direction, respectively, at predetermined process speeds (peripheral speeds). The surface of the rotating photosensitive drum 1 is electrically charged substantially uniformly to a predetermined polarity (negative in this embodiment) by the charging roller 2. At this time, to the charging roller 2, a predetermined charging bias is applied from a charging power source as a charging bias applying device. Then, the surface of the charged photosensitive drum 1 is exposed to a scanning beam from the exposure device 3 depending on image information corresponding to an associated image forming portion S, so that an electrostatic (latent) image according to the image information is formed. Then, the electrostatic image formed on the photosensitive drum 1 is positioned into a toner image with a toner of an associated color for the operated image forming portion S. The toner in the developing device 4 is negatively charged by and then is applied onto the developing sleeve 41 by the developer application blade 42. To the developing sleeve 41, a predetermined developing bias is applied from a developing power source as an unshown developing bias applying device. Then, when the electrostatic image formed on the photosensitive drum 1 reaches an opposing portion (developing portion) between the photosensitive drum 1 and the developing sleeve 41, the electrostatic image on the photosensitive drum 1 is visualized by the negative toner, so that the toner image is formed on the photosensitive drum 1.

Then, the toner image formed on the photosensitive drum 1 is transferred (primary-transferred) onto the rotationally driven intermediary transfer belt 8 by the action of the primary transfer roller 5 at the primary transfer portion N1. At this time, to the primary transfer roller 5, a primary transfer bias which is a DC voltage of an opposite polarity (positive in this embodiment) to the charge polarity of the toner during development is applied from a primary transfer power source E1 as a primary transfer bias applying device. For example, during full-color image formation, the electrostatic images are formed on the photosensitive drums 1 at certain delayed timing depending on a distance between adjacent primary transfer portions N1 for each of the colors, and then are developed into the toner images. Then, the respective color toner images formed on the photosensitive drums 1 of the image forming portions S are successively transferred (primary-transferred) in a superposition manner onto the intermediary transfer belt 8 at the primary transfer portions N1Y, N1M, N1C and N1K, so that a four-color based multi-color toner image is formed on the intermediary transfer belt 8.

Further, with formation of the electrostatic image by the exposure, a transfer(-receiving) material such as recording sheets stacked in an unshown transfer material accommodating cassette is picked up by an unshown transfer material supplying roller and then is fed to a registration roller pair 14 by unshown feeding rollers. The transfer material P is fed by the registration roller pair 14, in synchronism with the toner image on the intermediary transfer belt 8, to the secondary transfer portion N2 formed by the intermediary transfer belt 8 and the secondary transfer roller 14. Then, e.g., the four color toner images carried on the intermediary transfer belt 8 as described above are collectively transferred (secondary-transferred) onto the transfer material P at the secondary transfer portion N2 by the action of the secondary transfer roller 15. At this time, to the secondary transfer roller 15, from a secondary transfer power source E2 as a secondary transfer bias applying device, a secondary transfer bias which is a DC voltage having the opposite polarity (positive in this embodiment) to the charging polarity of the toner during the development is applied.

Thereafter, the transfer material P on which the toner images are transferred is fed to a fixing device 16. Then, the transfer material P is pressed and heated in a process in which the transfer material P is nipped and fed by a fixing roller and a pressing roller of the fixing device 16, so that the toner images are fixed on the transfer material P. The transfer material P on which the toner images are fixed is discharged as an image-formed product to the outside of the main assembly of the image forming apparatus 100.

Further, the toner (primary transfer residual toner) remaining on the photosensitive drum 1 without being completely transferred onto the intermediary transfer belt 8 at the primary transfer portion N1 is removed and collected from the surface of the photosensitive drum 1 by the drum cleaning device 6. Further, the toner (secondary transfer residual toner) remaining on the intermediary transfer belt 8 without being completely transferred onto the transfer material P at the secondary transfer portion N2 is removed and collected from the surface of the intermediary transfer belt 8 by the belt cleaning unit 12.

In this embodiment, the primary transfer roller 5 is constituted by a coating, around a core metal formed with a nickel-plated steel rod of 5 mm in outer diameter, an elastic layer formed with a foamable elastic material so as to have an outer diameter of 14 mm. The primary transfer roller 5 has an electric resistance of $10^6\Omega$. This electric resistance may preferably be in a range of $10^3\Omega$ to $10^7\Omega$ from the viewpoint that good image formation is effected.

In this embodiment, the secondary transfer roller 15 is constituted by a coating, around a core metal formed with a nickel-plated steel rod of 8 mm in outer diameter, an elastic layer formed with a foamable elastic material so as to have an outer diameter of 16 mm. The secondary transfer roller 15 has an electric resistance of $10^8\Omega$. This electric resistance may preferably be in a range of $10^7\Omega$ to $10^9\Omega$ from the viewpoint that good image formation is effected.

In this embodiment, the driving roller 9 is a roller of 26.3 mm in outer diameter prepared by coating, around an aluminum core metal, a silicone rubber of $10^5\Omega$ in electric resistance and 0.085 mm in thickness in which carbon black particles are dispersed as an electroconductive agent.

In this embodiment, the tension roller 10 is an aluminum-made metal roller (metal rod) of 24 mm in outer diameter, and applies, to the intermediary transfer belt 8, a tension of 49N in one side, i.e., 98N in total pressure at end portions thereof with respect to a rotational axis direction.

In this embodiment, the secondary transfer opposite roller 11 is a roller of 18 mm in outer diameter prepared by coating, around an aluminum core metal, an EPDM rubber of $10^5\Omega$ in electric resistance and 1 mm in thickness in which carbon black particles are dispersed as an electroconductive agent.

In the image forming apparatus 100, a control substrate (control portion) (not shown) on which an electrical circuit for effecting control of operations of respective portions of the image forming apparatus 100 is provided. On the control substrate, a CPU (not shown) as a control device and a memory (not shown) as a storing device in which various pieces of control information are stored are mounted. The CPU collectively controls the operation of the image forming apparatus 100, such as control of driving sources regarding feeding of the transfer material P and for the intermediary transfer belt 8 and the process cartridge 7, control regarding the image formation and control regarding failure detection.

2. Belt Cleaning Unit

Figure 2:
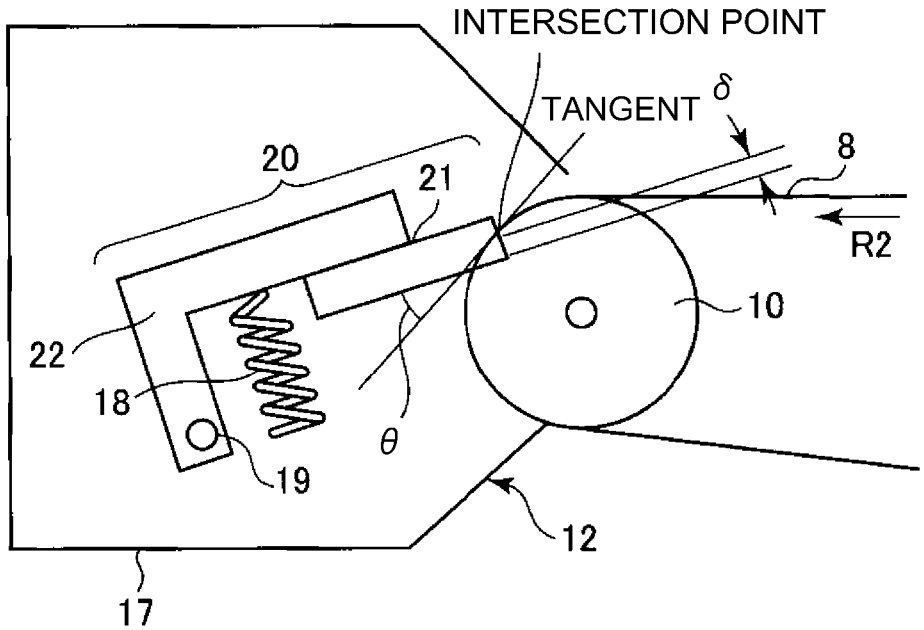
In FIG. 2, (a) and (b) are schematic sectional views in the neighborhood of a belt cleaning unit.
Figure 2:
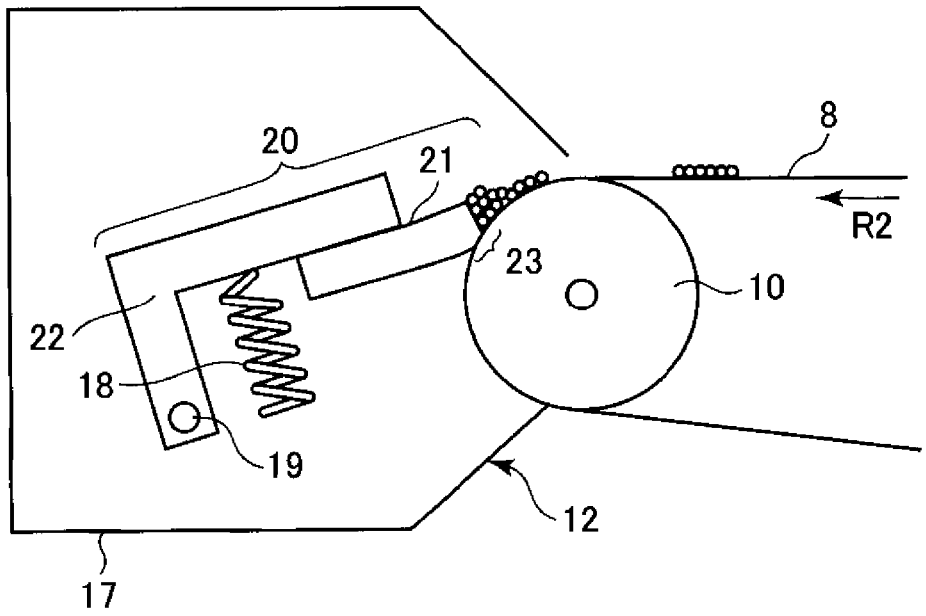

A structure of the belt cleaning unit 12 will be described. In FIG. 2, (a) is a phantom sectional view for illustrating a mounting position of the cleaning blade 21 in the case where the cleaning blade 21 described later is not elastically deformed, and (b) is a sectional view in the neighborhood of the belt cleaning unit 12.

The belt cleaning unit 12 includes a cleaning container 17 and a cleaning device 20 provided inside the cleaning container 17. The cleaning container 17 is constituted as a part of an unshown frame of the intermediary transfer belt unit 13. The cleaning device 20 includes the cleaning blade 21 as the cleaning member and a supporting member 22 for supporting the cleaning blade 21. The cleaning blade 21 is an elastic blade (rubber portion) formed of an urethane rubber (polyurethane), as a material therefor, which is an elastic material. The supporting member 22 is formed with a metal plate which is a plated steel plate (metal plate portion). The cleaning blade 21 is bonded to the supporting member 22 to constitute the cleaning device 20.

The cleaning blade 21 is a long plate member which has a predetermined thickness and which extends in one direction. The cleaning blade 21 has a long side and a short side which are substantially perpendicular to each other. The long side extending along a direction (thrust direction) substantially perpendicular to a belt feeding direction, and the short side contacts the intermediary transfer belt 8 at an end portion thereof. The cleaning blade 21 is 2 mm in thickness and 77 degrees in hardness as measured according to JIS K6253.

The cleaning device 20 is swingably constituted. That is, the supporting member 22 is swingably supported via a swinging shaft 19 fixed to the cleaning container 17. The supporting member 22 is urged (pressed) by a pressing spring 18 as an urging device provided inside the cleaning container 17, so that the cleaning device 20 is moved about the swinging shaft 19 to urge (press) the cleaning blade 21 against the intermediary transfer belt 8. Inside the intermediary transfer belt 8, the tension roller 10 is disposed opposed to the cleaning blade 21. The cleaning blade 21 is contacted to the intermediary transfer belt 8 with respect to a counter direction to the belt feeding direction at a position on the tension roller 10. That is, the cleaning blade 21 is contacted to the surface of the intermediary transfer belt 8 so that an edge of a free end thereof with respect to a short direction is directed toward an upstream side with respect to the belt feeding direction. As a result, a blade nip 23 is formed between the cleaning blade 21 and the intermediary transfer belt 8. The cleaning blade 21 scrapes off the toner, at the blade nip 23, from the surface of the moving intermediary transfer belt 8.

In this embodiment, the mounting position of the cleaning blade 21 is set in the following manner. As shown in (a) of FIG. 2, the cleaning blade 21 is 24 degrees in set angle θ, 1.5 mm in penetration depth (entering amount) δ and 0.6 N/cm in contact pressure. The set angle θ is an angle, at a point of intersection between the intermediary transfer belt 8 and the cleaning blade 21 (specifically, the free end surface thereof), formed between a tangential line of the tension roller 10 and the cleaning blade 21 (specifically, one surface thereof substantially perpendicular to a thickness direction thereof). The penetration depth δ is a length, with respect to the thickness direction, in which the cleaning blade 21 overlaps with the tension roller 10 in the phantom sectional view. The contact pressure is defined as an urging force (pressure) from the cleaning blade 21 at the blade nip 23, and is measured using a film pressure distribution measuring system (Trade name: "PINCH", manufactured by NITTA Corp.). By making the above setting, in a high-temperature/high-humidity environment (30° C./80% RH), turning-up and slip noise of the cleaning blade 21 can be suppressed, so that a good cleaning performance can be obtained. Further, by making the above setting, in a low-temperature/low-humidity environment (15 C/10% RH), defective cleaning is suppressed, so that the good cleaning performance can be obtained.

Figure 7:
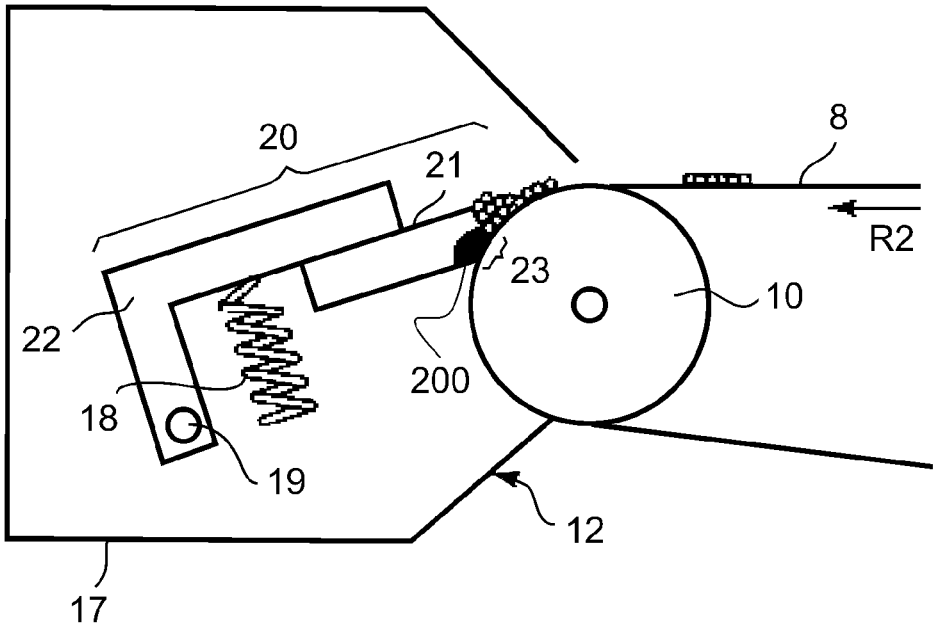
FIG. 7 is a schematic sectional view in the neighborhood of another belt cleaning unit.

Further, in general, urethane rubber and synthetic resin provide a large friction resistance due to sliding therebetween, so that initial turning-up of the cleaning blade 21 is liable to occur. Therefore, it is possible to apply an initial lubricant, such as graphite fluoride, onto the free end of the cleaning blade 21 in advance. Alternatively, as shown in FIG. 7, only in a region where the cleaning blade 21 contacts the belt, a coat layer 200 may also be provided. In order to reduce the frictional resistance between the cleaning blade 21 and the intermediary transfer belt 8, the coat layer 200 has a frictional resistance lower than the cleaning blade 21.

The rubber hardness of the cleaning blade 21 is appropriately selected depending on the material for the intermediary transfer belt 8 or the like, but may preferably be in a range of 70 degrees or more and 80 degrees or less as measured according to JIS K6263. When the rubber hardness is lower than the above range, a wearing (abrasion) amount with use increases and durability lowers in some cases. When the rubber hardness is higher than the above range, an elastic force decreases and thus chipping grooves due to the friction with the intermediary transfer belt 8 in some cases. Further, the contact pressure is appropriately selected depending on the material for the intermediary transfer belt 8 or the like, but may preferably be in a range of 0.4 N/cm or more and 0.8 N/cm or less. When the contact pressure is smaller than the above range, the good cleaning performance cannot be obtained in some cases. When the contact pressure is larger than the above range, a load for rotationally driving the intermediary transfer belt 8 becomes excessive.

3. Intermediary Transfer Belt

Figure 3:
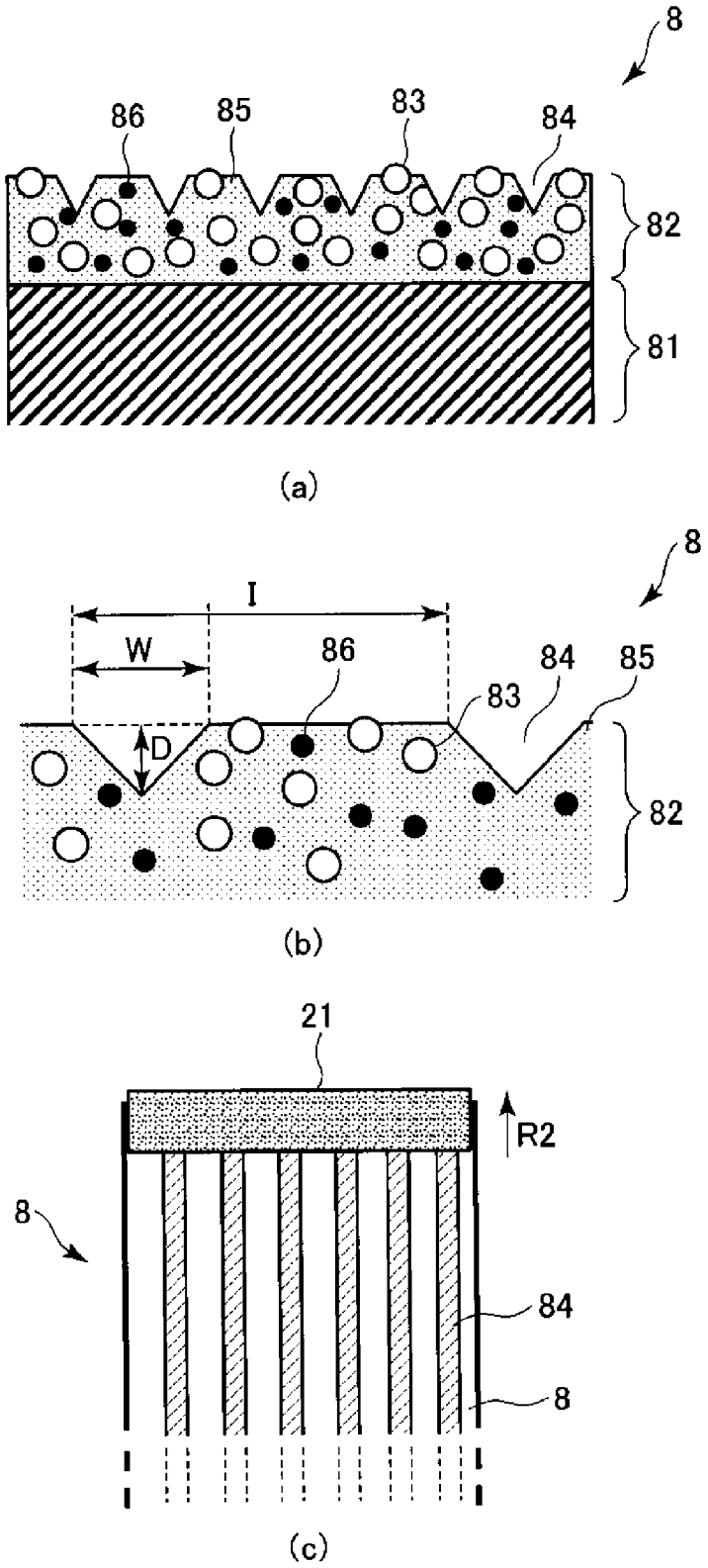
In FIG. 3, (a) to (c) are schematic views of an intermediary transfer belt, in which (a) and (b) are sectional views, and (c) is a top view.

A structure of the intermediary transfer belt 8 in this embodiment will be described. In FIG. 3, (a) is a schematic partially enlarged sectional view of the intermediary transfer belt 8 cut in a direction substantially perpendicular to the belt feeding direction, (b) is a detailed view thereof in which a surface layer 82 of the intermediary transfer belt 8 is shown in an enlarged state, and (c) is a schematic top (plan) view showing the intermediary transfer belt as seen from above the intermediary transfer belt 8.

The intermediary transfer belt 8 is an endless belt member (or film member) including two layers consisting of a base layer 81 and the surface layer 82. The surface layer 82 carries (holds) the toner transferred from the photosensitive drum 1. The base layer 81 is a 70 μm-thick layer in which carbon black particles are dispersed as an electric resistance adjusting agent into polyethylene naphthalate resins. The surface layer 82 is a 3 μm-thick layer in which antimony-doped zinc oxide particles as an electric resistance adjusting agent 86 into acrylic resin as a base material 85 and polytetrafluoroethylene (PTFE) particles as a lubricant 83 are added. The lubricant 83 added in the surface layer 82 partly protrudes from an outermost surface of the surface layer 82 at least before start of use of the intermediary transfer belt 8, thus forming a projected shape in a partly exposed state. The lubricant 83 added in the surface layer 82 exists in a dispersed state in the base material 85, other than the partly exposed state.

Further, the surface layer 82 is provided with grooves (grooved shape, groove portion) 84 formed along a surface movement direction of the intermediary transfer belt 8 (belt feeding direction). As an example, each of the grooves 84 is 2 μm in width W (width of an opening with respect to a direction substantially perpendicular to a longitudinal axial direction of the groove 84) and is 1 μm in depth D (depth from the opening to the bottom with respect to the thickness direction of the intermediary transfer belt 8). As will be specifically described later, the width W of each groove 84 is below ½ of an average particle size of the toner. Further, a pitch I of the grooves 84 (an interval between adjacent two grooves 84 with respect to the direction substantially perpendicular to the belt feeding direction) is 10 μm to 100 μm, typically 10 μm to 20 μm. The thickness of the surface layer 82 is 3 μm, and therefore the grooves 84 do not reach the base layer 81 but existent only at the surface layer 82. The grooves 84 exist over one full circumference of the intermediary transfer belt 8 along a circumferential direction (rotational direction) of the intermediary transfer belt 8.

As will be specifically described later, the grooves 84 is formed at the surface of the surface layer 82 by surface treatment in which a lapping film as a shape-imparting device is contacted to the surface of the intermediary transfer belt 8. In this embodiment, the grooves 84 are in a positional relationship such that the grooves 84 are substantially perpendicular to the longitudinal direction of the contact portion between the cleaning blade 21 and the intermediary transfer belt 8. That is, in this embodiment, the grooves 84 are linearly formed, so that the belt feeding direction and a longitudinal axial direction of the grooves 84 are substantially parallel with each other. Further, in this embodiment, the grooves 84 are continuously formed over one full circumference along the circumferential direction (rotational direction) of the intermediary transfer belt 8. Further, in this embodiment, the grooves 84 are formed so that the pitches I are provided at random. The pitches I do not always have periodicity although this may vary depending on the surface treatment method. Further, the grooves 84 may also be formed so that the pitches I are substantially equal to each other in the above range. Further, the grooves 84 may also be interrupted partway without being continuously formed over one full circumference along the circumferential direction (rotational direction) of the intermediary transfer belt 8. That is, the grooves 84 are intermittently formed over one full circumference along the circumferential direction (rotational direction) of the intermediary transfer belt 8. The direction along the belt feeding direction includes, e.g., the case where the grooves 84 are helically formed while moving the lapping film in the thrust direction. That is, the grooves 84 may only be required to extend along a direction crossing the direction (represented by the rotational axis direction of the driving roller) substantially perpendicular to the belt feeding direction, and may also have an angle relative to the belt feeding direction. However, in order to obtain an effect specifically described later, an angle formed by the longitudinal axis direction of each groove 84 relative to the belt feeding direction may preferably be 45 degrees or less, more preferably be 10 degrees or less. Typically, as in this embodiment, the belt feeding direction and the longitudinal axis direction of each groove 84 are substantially parallel with each other. Further, the grooves 84 may have a shape, other than a rectilinear shape, as a whole. For example, the grooves 84 may be bent or curved partway or may also be curved as a whole.

The intermediary transfer belt 8 has a volume resistivity of $10^{10}$ Ω·cm as measured by a device ("Hiresta-UP MCP-HT450", manufactured by Mitsubishi Chemical Corp.) in an environment of 25° C. in temperature and 50% RH in relative humidity.

The volume resistivity of the intermediary transfer belt 8 may preferably be in a range of $10^{9}$ Ω·cm to $10^{12}$ Ω·cm from the viewpoint that good image formation is effected.

4. Preparation Method of Intermediary Transfer Belt

A preparation method of the intermediary transfer belt 8 will be described.

As a material used for the base layer 81, it is possible to use thermoplastic resin materials such as polycarbonate, polyvinylidene fluoride (PVDF), polyethylene, polypropylene, polymethylpentene-1, polystyrene, polyamide, polysulfone, polyalylate, polyethylene terephthalate, polybutylene terephthalate, polyethylene naphthalate, polybutylene naphthalate, polyphenylene sulfide, polyether sulfide, polyether nitrile, thermoplastic polyamide, polyether ether ketone, thermotropic liquid crystal polymer, and polyamide acid. These materials can also be in mixture of two or more species. Further, an electroconductive material is melt-kneaded in these thermoplastic resin materials and then is subjected to molding, which is appropriately selected, such as inflation molding, cylindrical extrusion molding or blow molding, so that it is possible to obtain the base layer 81 of the intermediary transfer belt 8.

On the other hand, for the surface layer 82, from the viewpoints that the surface hardness of the intermediary transfer belt 8 is enhanced and that durability is improved, a curable material which is curable by heat or irradiation with energy line such as light (UV rays) or electron beam can be suitably used. Particularly, the curable material which is curable by irradiation with UV rays or electron beam which are high in curing property may preferably be used, but is not limited thereto. The curable material includes an organic material and an inorganic material. As the organic material, it is possible to use curable resin materials such as melamine resin, urethane resin, alkyd resin, acrylic resin, and fluorine-based curable resin (fluorine-containing curable resin). As the organic material, it is possible to use alkoxysilane-based material, alkoxyzirconium-based material and silicate-based material. As a hybrid material between the organic material and the inorganic material, it is possible to use an inorganic fine particles-dispersed organic polymeric material, an inorganic fine particles-dispersed organoalkoxysilane-based material, alkylsilicone-based material and organoalkoxysilane-based material. From the viewpoint of strength such as anti-wearing property or anti-cracking property of the surface layer 82 of the intermediary transfer belt 8, of the curable materials, the resin material (curable resin) is preferred, and of the curable resins, acrylic resin obtained by curing an unsaturated double bond-containing acrylic copolymer is preferred. The unsaturated double bond-containing acrylic resin is available as, e.g., "Rushifuraru (trade name)", which is an acrylic UV-curable hard coat material, from Nippon Paint Co., Ltd. That is, the intermediary transfer belt 8 may preferably have the surface layer (cured film, surface-cured layer) 82 obtained by irradiating and curing, with energy line, a liquid containing a UV curable monomer and/or oligomer.

Further, into the surface layer 82, the electroconductive material (electroconductive filler, electrical resistance adjusting agent) 86 can be added for the purpose of adjusting the electric resistance. As the electroconductive material 86, it is possible to use an electron conductive material or an ion conductive material. As the electron conductive material, it is possible to use, e.g., a carbon-based electroconductive filler, having a particle shape, a fiber shape or a flake shape, such as carbon black, PAN-based carbon fiber or expanded graphite pulverized product. Further, it is possible to use a metal oxide-based electroconductive filler, having a particle shape, such as zinc antimonate, antimony-doped tin oxide, antimony-doped zinc oxide, tin-doped indium oxide or aluminum-doped zinc oxide. As the ion conductive material, it is possible to use, e.g., an ionic liquid, an electroconductive oligomer or quaternary ammonium salt. From these electroconductive materials, one species or more is appropriately selected, and the electroconductive material and the ion conductive material may also be used in mixture. Of these electroconductive materials, the metal oxide-based electroconductive filler having the particle shape (such as particles of submicron or less) may preferably be used from a viewpoint such that an addition amount is small and a desired surface smoothness of the surface layer 82 can be obtained.

Further, into the surface layer 82, it is possible to add the solid lubricant 83. Examples of the solid lubricant 83 may include fluorine-containing particles such as polytetrafluoroethylene (PTFE) powder, polychlorotrifluoroethylene resin powder, tetrafluoroethylene-hexafluoropropylene resin powder, vinylfluoride resin powder, vinylidenefluoride resin powder, dichlorodifluoroethylene resin powder, graphite fluoride, and copolymers of these resins. From these materials, one or more species can be appropriately selected. Further, the solid lubricant 83 is not always limited to these resins, but may also be silicone resin particles, silica particles, molybdenum disulfide, or the like. Of these materials, PTFE resin particles (of an emulsion polymerization type) may preferably be used from a viewpoint that a friction coefficient of the surface of particles is low and a degree of wearing of another member, such as the cleaning blade 21, contacting the surface layer 82 of the intermediary transfer belt 8 can be reduced.

An example of the preparation method of the surface layer 82 is shown as follows. A surface layer forming coating liquid is prepared by mixing antimony-doped zinc oxide as the electroconductive material and PTFE particles as the solid lubricant into unsaturated double bond-containing acrylic copolymer and then by dispersing and mixing a resultant mixture by a high-pressure emulsion-dispersing machine. Further, as a method of forming the surface layer 82 on the base layer 81, it is possible to use an ordinary coating method such as dip coating, spray coating, roll coating or spin coating. From these methods, an appropriate method is selected and used, so that the surface layer 82 having a desired thickness can be obtained. An example of a specific preparation method will be described later.

The grooves 84 are formed on the above-obtained surface layer 82 of the intermediary transfer belt 8. The grooves 84 can be formed by bringing the lapping film into contact with the surface layer 82 to rotate the intermediary transfer belt 8 or rubbing the surface layer 82 with the lapping film with respect to the rotational direction of the intermediary transfer belt 8. Further, the method of imparting a desired surface shape to the surface layer 82 of the intermediary transfer belt 8 is not limited to a process using the lapping film. It is possible to impart the desired surface shape to the surface layer 82 of the intermediary transfer belt 8 by an arbitrary method. For example, it is possible to use a method of imparting a desired surface shape to the surface of the base layer 81 before the coating of the surface layer 82 or a post-process using a metal mold or a nanoimprint technology. An example of a specific processing method will be described later.

5. Relationship Between Surface Layer and Transfer Efficiency of Intermediary Transfer Belt In FIG. 4, (a) to (c) are schematic enlarged view of a contact portion between the surface layer 82 of the intermediary transfer belt 8 and the toner.

In order to improve the transfer efficiency when the toner (image) is transferred from the intermediary transfer belt 8 onto the transfer material P, it is desired that the surface layer 82 of the intermediary transfer belt 8 is smooth. As shown in (a) of FIG. 4, in the case where an average in-plane roughness of the surface layer 82 is 10 nm or less and an occupied proportion by a smooth portion is dominant, a contact opportunity (contact area) between the toner and the surface layer 82 is less, so that the toner and the surface layer 82 principally point-contact each other. The average in-plane roughness represents a surface roughness (or surface smoothness) in a minute region, and a measuring method thereof will be described later. As a result, a physically depositing force acting between the toner and the surface layer 82 is weak and thus a toner parting property becomes good, and therefore the transfer efficiency tends to improve.

Figure 4:
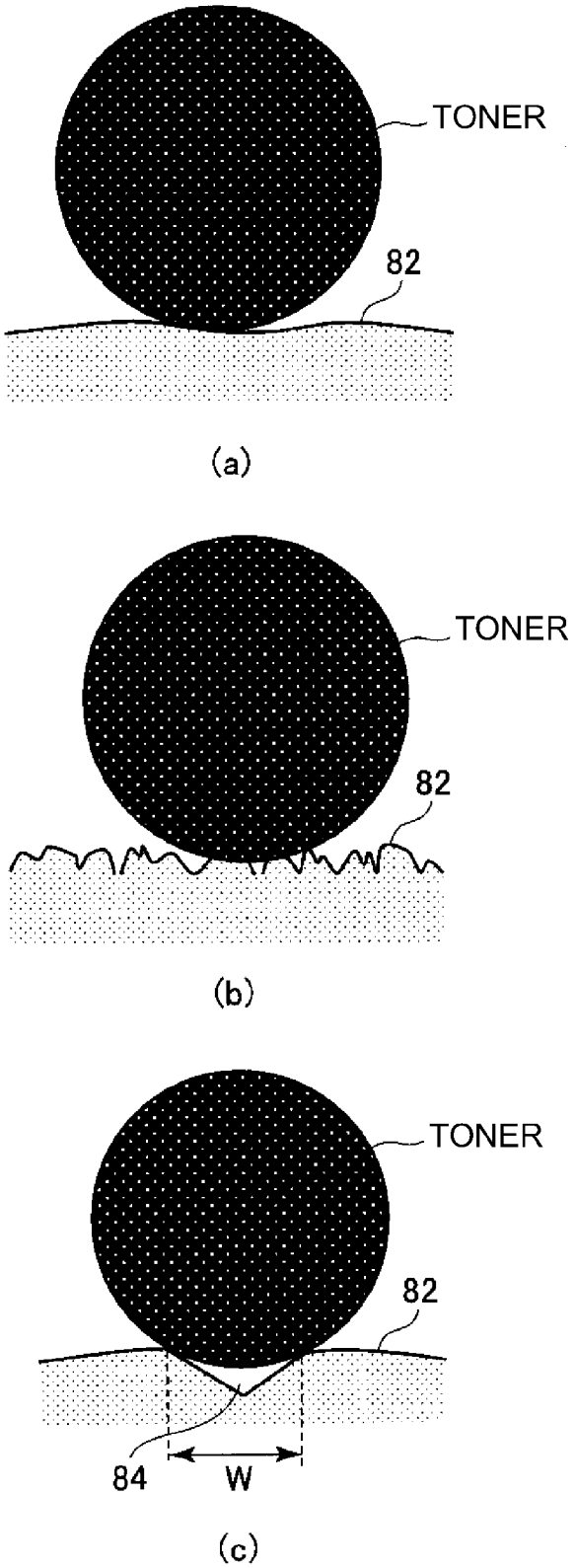
In FIG. 4, (a) to (c) are schematic enlarged views of a contact portion between a surface layer of the intermediary transfer belt and a toner.

Further, as shown in (b) of FIG. 4, in the case where the average in-plane roughness of the surface layer 82 is larger than 30 nm and the smooth portion does not exist, the contact opportunity (contact area) is large, so that the toner and the surface layer 82 principally contact each other at many points. As a result, the physically depositing force acting between the toner and the surface layer 82 is strong and thus the toner parting property becomes weak, and therefore the transfer efficiency tends to lower.

On the other hand, at the surface layer 82 where the groove 84 having a width which is less than ½ of an average particle size of the toner is formed on the smooth surface layer 82, e.g., in the case of a spherical toner, there is a possibility that the toner exists on the groove 84. The toner on the groove 84 has the width W smaller than the particle size of the toner, and therefore exists on the surface layer 82 in a two-point contact manner with the surface layer 82 without being buried in the groove 84. For that reason, compared with the surface layer 82 ((b) of FIG. 4) where the smooth portion does not exist, the physically depositing force acting between the toner and the surface layer 82 is weak. Accordingly, the intermediary transfer belt 8 provided with such grooves 84 enables suppression of wearing of the cleaning 21 as described specifically later while maintaining a sufficient transfer efficiency.

As described above, in order to improve the transfer efficiency, it is desired that the surface layer 82 of the intermediary transfer belt 82 has smoothness such that the surface layer 82 point-contacts the toner. As specifically described later, according to study by the present inventors, a good transfer efficiency can be obtained in the case where the average in-plane roughness of the surface layer 82 is 30 nm or less. This can be achieved by forming the grooves 84 on the smooth surface of the intermediary transfer belt 8 along a surface movement direction of the intermediary transfer belt 8 (i.e., along a direction crossing a longitudinal direction of the contact portion between the cleaning blade 21 and the intermediary transfer belt 8).

The tendency regarding the transfer efficiency as described above is not limited to the spherical toner, but is similarly shown in the case where a non-spherical toner is used. The surface layer 82 of the intermediary transfer belt 8 is smooth, so that the contact area is lowered and thus the transfer efficiency tends to improve.

7. Wearing Between Intermediary Transfer Belt Surface Layer and Cleaning Blade In FIG. 5, (a) to (d) are schematic enlarged views each showing the contact portion (blade nip 23) between the surface layer 82 of the intermediary transfer belt 8 and the cleaning blade 21.

In order to satisfy a cleaning performance of the intermediary transfer belt 8, it is desired that the surface layer 82 of the intermediary transfer belt 8 has a proper roughness. In this embodiment, the grooves 84 formed on the surface layer 82 of the intermediary transfer belt 8 are in a positional relationship substantially perpendicular to a longitudinal direction of the control between the cleaning blade 2 and the intermediary transfer belt 8. As shown in (a) of FIG. 5, in the case of the intermediary transfer belt 8 having the surface layer 82 provided with the grooves 84, the cleaning blade 21 does not contact the grooves 84, and therefore the contact area between the cleaning blade 21 and the intermediary transfer belt 8 at the blade nip 23 lowers. For that reason, a frictional force at the blade nip 23 during the rotational drive of the intermediary transfer belt 8 decreases, so that wearing (abrasion) of the cleaning blade 21 is suppressed. Further, the width W of the groove 84 is smaller than the average particle size of the toner, and therefore the toner is prevented from entering the groove 84 and pass through the cleaning blade 21.

Figure 5:
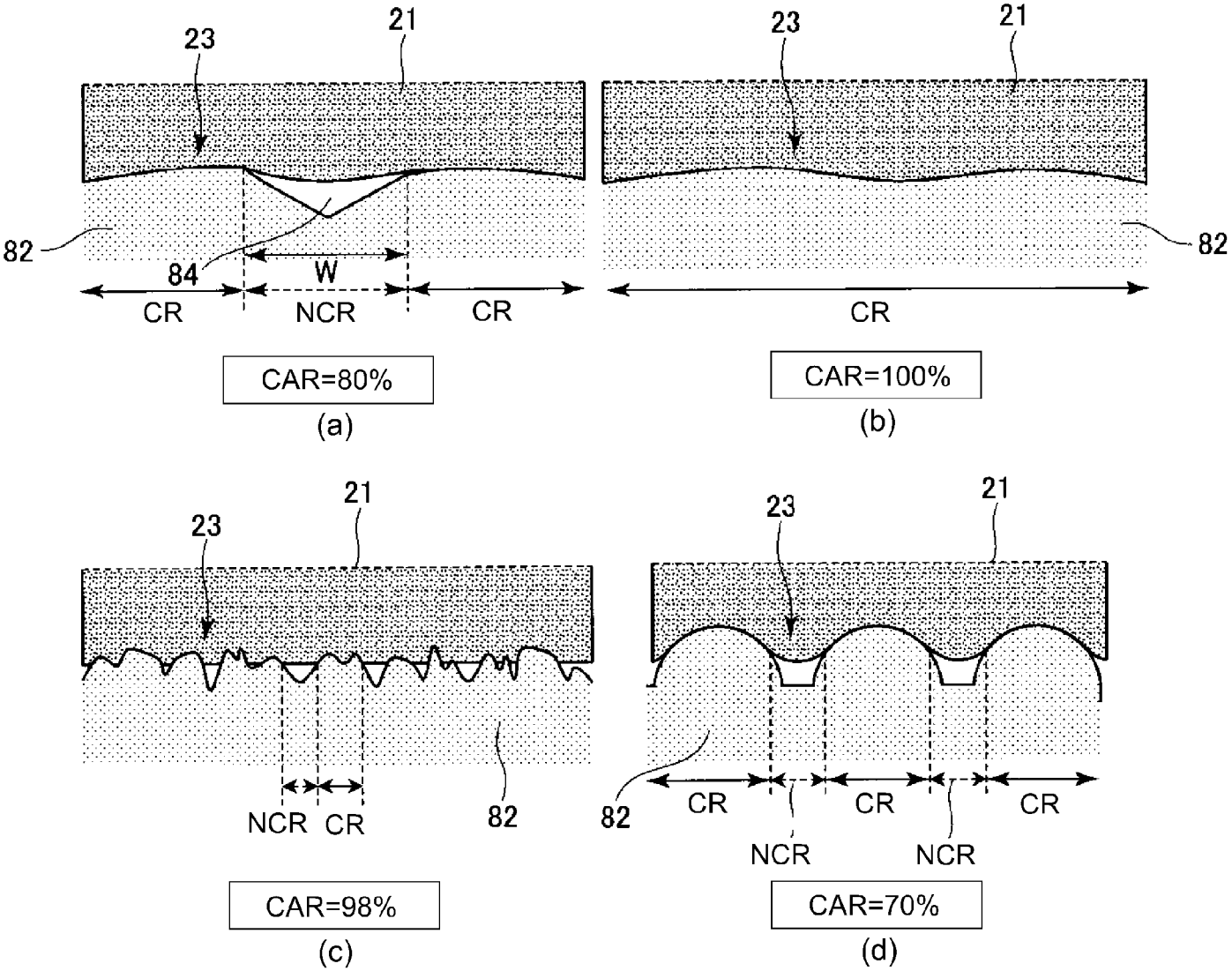
In FIG. 5, (a) to (d) are schematic enlarged views of a contact portion between the surface of the intermediary transfer belt and a cleaning blade.

On the other hand, as shown in (b) of FIG. 5, in the case of the intermediary transfer belt 8 having a smooth surface layer 82 where an uneven shape does not exist at all, the cleaning blade 21 is in a state in which the cleaning blade 21 closely contacts the intermediary transfer belt 8 substantially completely at the blade nip 23. For that reason, the frictional force at the blade nip 23 during the rotational drive of the intermediary transfer belt 8 is large, so that wearing of the cleaning blade 21 advances by repetitive use and thus defective cleaning (improve cleaning) can occur.

Further, as shown in (c) of FIG. 5, in the case of the intermediary transfer belt 8 having the surface layer 82 to which a random uneven shape is imparted, the cleaning blade 21 selectively contacts a projected portion of the surface layer 82 at the blade nip 23. For that reason, at the cleaning nip 23, pressure is concentratedly applied to the contact region portion between the cleaning blade 21 and the surface layer 82, so that the frictional force at the contact region portion becomes large. As a result, the wearing of the cleaning blade 21 locally advances by repetitive use and thus local wearing or chipping grooves, so that the defective cleaning can occur.

Further, as shown in (d) of FIG. 5, also in the case of the intermediary transfer belt 8 having the surface layer 82 to which a projected shape imparted by addition of a filler, similarly as in the case of (c) of FIG. 5, the cleaning blade 21 selectively contacts the projected portion of the surface layer 82 at the blade nip 23. For that reason, by the repetitive use, the wearing of the cleaning blade 21 contacting the projected portion of the surface layer 82 locally advances to generate the local wearing or chipping, so that the defective cleaning can occur.

As described above, in order to obtain a good cleaning performance for a long term, it is desired that the contact area between the cleaning blade 21 and the intermediary transfer belt 8 is decreased at the blade nip 23. This is achieved by forming the grooves 84 on the smooth surface of the intermediary transfer belt 8 along the surface movement direction of the intermediary transfer belt 8 (i.e., along the direction crossing the longitudinal direction of the contact portion between the cleaning blade 21 and the intermediary transfer belt 8).

A proportion (ratio) of the contact area between the intermediary transfer belt 8 and the cleaning blade 21 to a total area of the intermediary transfer belt 8 within a range of the cleaning blade 21 (with in an opposing region between the blade and the belt) with respect to the direction substantially perpendicular to the belt feeding direction is defined as a contact area ratio. The contact area ratio can be obtained, as a ratio of the contact region portion with the cleaning blade 21 to the total area of the intermediary transfer belt 8 in an arbitrary region of the surface layer 82, by a measuring method described specifically later. In this case, in order to obtain the good cleaning performance by the frictional force decreasing effect as described above, the contact area ratio may preferably be 80% or more and 97% or less. In the case where the contact area ratio is less than 80%, the pressure is concentratedly applied excessively to the contact region portion since an area of the surface layer 82 of the intermediary transfer belt 8 contacting the cleaning blade 21 is small, and therefore a wearing (abrasion) amount of the cleaning blade 21 is liable to increase. In the case where the average in-plane roughness is larger than 97%, the frictional force decreasing effect is not achieved due to the decrease in contact portion, so that the cleaning blade wearing amount is liable to increase.

As described above, by forming the grooves 84 appropriately on the surface of the intermediary transfer belt 8 along the belt feeding direction, it is possible to suppress the wearing of the cleaning blade 21 while improving the toner transfer efficiency from the intermediary transfer belt 8 onto the transfer P.

When the structure in which the grooves 84 are formed on the surface of the intermediary transfer belt 8 along the direction perpendicular to the belt feeding direction is considered in cross-section, the structure is substantially same as the structure shown in (b) of FIG. 5. For that reason, by the repetitive use, the wearing of the cleaning blade 21 advances, so that the defective cleaning occurs. For that reason, there is a need that the direction of the grooves 84 formed on the intermediary transfer belt 8 is the direction crossing the direction perpendicular to the belt feeding direction of the intermediary transfer belt 8.

7. Embodiments and Comparison Examples

The above-described effect will be described specifically based on Embodiments and Comparison Examples.

Embodiment 1

In this embodiment, the intermediary transfer belt 8 having two layers consisting of the base layer 81 and the surface layer 82 was used. The preparation method of the intermediary transfer belt 8 will be described.

<Preparation of Base Layer>

First, the preparation method of the base layer 81 will be described. A polyethylene naphthalate resin material was subjected to blow molding to obtain a bottle-shaped product, and then the bottle-shaped product was cut by an ultrasonic cutter to obtain an endless belt member. In the polyethylene naphthalate resin material, carbon black is dispersed in advance as an electric resistance adjusting agent. The thus-obtained 70 μm-thick polyethylene naphthalate resin belt was used as the base layer 81 of the intermediary transfer belt 8.

<Preparation of Coating Liquid (UV Curable Resin Component) for Forming Surface Layer>

Next, the preparation method of a coating liquid (UV curable resin composition) for forming the surface layer 82 will be described. In a container from which UV rays are shielded, an acrylic UV curable hard coat material ("Rushifuraru" (trade name), manufactured by Nippon Paint Co., Ltd.) containing pentaerythritol triacrylate and pentaerythritol tetraacrylate was mixed in PTFE particles ("Lubron", manufactured by Daikin Industries Ltd.), of 200 nm in particle size, as the lubricant (sliding property imparting particles) 83, and therein as a dispersant for the PTFE particles, a fluorine-containing graft polymer ("GF400" (trade name), manufactured by Toagosei Co., Ltd.) having a high molecular weight and methyl isobutyl ketone were added and roughly dispersed by a high-speed shearing dispersing device (homogenizer). Thereafter, the roughly dispersed mixture was dispersed using a high-pressure emulsion dispersing device ("Nano β, manufactured by Yoshida Kikai Co., Ltd.). Then, the resultant dispersed mixture (in which the PTFE particles were dispersed) was added dropwise in a liquid in which a low-molecular weight amine was added as a dispersant in electroconductive particles ("Cell Nacs 210IP" (trade name), manufactured by Nissan Chemical Industries, Ltd.) while stirring the liquid, so that the coating liquid for forming the surface layer 82 was obtained.

<Preparation of Intermediary Transfer Belt Having Surface Layer>

Next, a method of forming the surface layer 82 on the base layer 81 will be described. On the above-described base layer 81 of the intermediary transfer belt 8, the above-prepared UV curable resin composition was dip-coated in a coating environment of 25° C. in temperature and 60% RH in relative humidity. Then, after a lapse of 10 seconds from an end of the coating, the composition was irradiated with UV ray by using a UV ray irradiation device (trade name: "UE06/81-3", manufactured by Eye Graphics Co., Ltd., light quantity: 1000 mJ/cm$^2$) placed in the same environment as the coating environment, so that the surface layer 82 was cured. As a result, a 3 μm-thick cured resin film was formed and was used as the surface layer 82 of the intermediary transfer belt 8. In this way, the intermediary transfer belt 8 having the surface layer 82 was prepared.

<Formation of Surface Grooves of Intermediary Transfer Belt>

Next, the grooves 84 was formed on the surface layer 82 of the intermediary transfer belt 8 obtained by the above-described method. The intermediary transfer belt 8 is mounted on a cylinder having an outer diameter somewhat larger than an inner diameter thereof by being elastically deformed. A lapping film ("Lapika #2000" (trade name), manufactured by Kovax Corp.) using aluminum oxide particles, of 9 μm in particle size, as abrasive grain is contacted to the surface of the intermediary transfer belt 8 mounted on the above-described cylinder at a contact pressure of 1.96 N/nm$^2$. Then, by rotating the cylinder for 40 seconds, the intermediary transfer belt 8 having the surface layer 82 provided with the grooves 84 each having the width W of 2 μm and the depth D of 1 μm was obtained.

<Measuring Method of Average Particle Size of Toner>

The average particle size of the toner was measured using Coulter Multisizer (mfd. by Coulter Co. Ltd.). Analysis of data was made by connecting the Coulter Multisizer with an interface (mfd. by Nikkaki Bios Co., Ltd.) for outputting a number-average distribution and a volume-average distribution, and a personal computer. As an electrolytic solution, a 1%-NaCl aqueous solution prepared by using reagent-grade sodium chloride was used. As such an electrolytic solution for example, "ISOTON R-II" (mfd. by Coulter Scientific Japan Co.) can be used. The measuring method was as follows. To 100-150 ml of the electrolytic solution, 0.1-0.5 ml of a surfactant as a dispersant, preferably, alkylbenzenesulfonic acid salt, was added, and to this mixture, 2-20 mg of test sample was added. Then, the electrolytic solution in which the test sample was added was dispersed in an ultrasonic dispersing device for roughly 1-3 minutes. Then, a volume and the number of the toner particles in the range of 2 μm or more in particle size were measured with the use of the above-mentioned Coulter Counter TA-II fitted with a 100 μm-aperture to calculate the volume distribution and the number distribution.

By using these values, a weight-average particle size based on the weight of the toner particles was obtained (by using a center value of each channel as a represented value of each channel), and this value was used as an average particle size of the toner. In this embodiment, the average particle size of the toner was 6 μm.

<Surface Layer Observation Evaluation 1>

Measurement of the average in-plane roughness of the surface layer 82 of the intermediary transfer belt 8 in an observation field of view (an area of a square of the average particle size) of the surface layer 82 of the intermediary transfer belt 8 prepared by the above method was made. For measurement, a scanning probe microscope ("SPI3800", manufactured by SII Nano Technology Inc.) was used. A cantilever used is formed of silicone, and is 15 (nm) or less in end diameter, 15 (N/m) in spring constant and 136 (kHz) in resonance frequency. As a measuring mode, a dynamic force mode in which a high-accuracy image on the order of nm can be obtained without breaking a sample was used. A measurement frequency is 0.3-1.0 (Hz). The observation field of view was determined from the average particle size obtained by the above measuring method, and then an average in-plane roughness Ra of the surface layer 82 of the intermediary transfer belt 8 in an area of 6 μm was measured. An average of values measured at non-overlapping 10 points was used as the measured average in-plane roughness Ra.

<Surface Layer Observation Evaluation 2>

A 10-point average roughness Rzjis at the surface layer 82 of the intermediary transfer belt 8 prepared by the above method was measured. The measurement, a surface roughness/contour from measuring device ("Surfcom 1500SD", manufactured by Tokyo Seimitsu Co., Ltd.) was used, and the measurement was made according to JIS B0601 (2001) under a condition of 0.25 mm in cut-off wavelength, 0.25 mm in development reference length and 1.25 mm in measurement length. The 10-point average roughness Rzjis as measured by scanning the surface of the surface layer 82 with a stylus of the measuring device in a direction substantially perpendicular to a surface movement direction of the intermediary transfer belt, and an average of values measured at arbitrary at least 5 points was used as a measured value.

<Surface Layer Observation Evaluation 3>

A contact area ratio at the surface layer 82 of the intermediary transfer belt 8 prepared by the above method was measured. For measurement, a confocal microscope ("Optelics", manufactured by Lasertec Corp.) was used. An observation region was 10 μm square, and a measurement wavelength was 546 nm. Scanning was made with respect to a thickness of 3 μm of the surface layer 82 at a scanning frequency of 0.2 μm with respect to a thickness direction of the intermediary transfer belt 8. From an obtained surface shape, the contact area ratio was calculated using the following method. A threshold is provided at a position toward the base layer 81 by 0.3 μm from the outermost surface portion in the measurement region. A region of less than 0.3 μm from the outermost surface is defined as a contact area, and a region of not less than 0.3 μm from the outermost surface is defined as a non-contact area. The contact area ratio was calculated by the following equation.

$$\text{Contact area ratio (\%)} = ((\text{area of contact region})/(\text{area of observation region})) \times 100$$

An average of values measured at at least 5 arbitrary points by the above method was used as a measured value. This value can represent a proportion (ratio) of a contact area between the intermediary transfer belt 8 and the cleaning blade 21 to a total area of the intermediary transfer belt 8 within a range of the cleaning blade 21 with respect to a direction substantially perpendicular to the surface movement direction of the intermediary transfer belt 8.

<Transfer Efficiency Evaluation>

The intermediary transfer belt 8 prepared by the above method was mounted in the image forming apparatus 100 in this embodiment shown in FIG. 1, and evaluation of the transfer efficiency was made. An image pattern was formed by superposing solid images of yellow, magenta and cyan so as to have a toner amount per unit area of 1.3 mg/cm$^2$ on the intermediary transfer belt 8. The toner image having this image pattern was secondary-transferred onto the transfer material by an optimum secondary transfer bias. Then, the transfer efficiency was calculated from toner amounts before and after the secondary transfer by the following equation.

$$\text{Transfer efficiency (\%)} = ((\text{toner amount after transfer})/(\text{toner amount before transfer})) \times 100$$

Evaluation of the transfer efficiency was made using a transfer material ("25% Cotton Content" (trade name)) in an environment of 25° C. in temperature and 50% RH in relative humidity. At this time, in the case where the transfer efficiency was less than 94%, image defect (graininess or white dropout of the toner) which was at a visually recognizable level generated.

<Durability Evaluation of Cleaning Performance>

In order to check a durability of the cleaning performance, sheet passing durability evaluation was made using the image forming apparatus 100 in this embodiment shown in FIG. 1 in which the intermediary transfer belt 8 provided by the above method. Specifically, generation of the defective cleaning was checked by effecting sheet passing of $100\times10^3$ sheets in a two-sheet intermittent printing manner using A4-sized paper ("Extra", manufactured by Océ N.V.) (basis weight: 80 g/m$^2$) in an environment of 25° C. in temperature and 50% RH in relative humidity.

An evaluation method of the cleaning performance is as follows. In a state in which the secondary transfer voltage application is turned off (0 V), a red image (combination of the yellow toner and the magenta toner) is printed on a whole surface of A4-sized paper, and thereafter the secondary transfer voltage is set to a proper value, and then 3 sheets are continuously passed through the secondary transfer portion N2 in a blank state. As a result, the yellow and magenta toners remaining on the intermediary transfer belt without being almost transferred onto the transfer material P at the secondary transfer portion N2 enter the cleaning blade 21. If these toners can be removed, the 3 sheets to be passed thereafter are outputted in the blank state, but if the toners are not removed, the toners slipping through the cleaning blade 21 are transferred onto the blank sheets, so that the resultant image is outputted as a defective cleaning image. The above evaluation was made every passing of $10\times10^3$ sheets. After the passing of $100\times10^3$ sheets, if the cleaning was made, an evaluation result is "o", and if the cleaning was not made, the evaluation result is "x".

The evaluation results of the transfer efficiency and the durability of the cleaning performance are shown in Table 1 appearing hereinafter. In transfer efficiency evaluation, at the transfer efficiency of 95.6%, the image defect of a visually observable level was not generated, so that it was confirmed that a good transfer property can be obtained. In the evaluation of the durability of the cleaning performance, the defective cleaning was not generated even after the passing of $100\times10^3$ sheets, so that it was confirmed that the good transfer property can be obtained.

Embodiment 2

In this embodiment, the depth D was made larger than that in Embodiment 1, and then the transfer efficiency and the cleaning performance durability with respect to the intermediary transfer belt 8 provided with the grooves 84 of 2 μm in width W and 1.5 μm in depth D were checked. The intermediary transfer belt 8 having the surface layer 82 was obtained similarly as in Embodiment 1 except that a time of contact of the lapping film with the intermediary transfer belt 8 when the grooves 84 were formed on the surface layer 82 of the intermediary transfer belt 8 was changed to 80 sec.

The evaluation results of the transfer efficiency and the cleaning performance durability are shown in Table 1 appearing hereinafter. Similarly as in Embodiment 1, a good transfer property of 95.2% in transfer efficiency was obtained, and even after the passing of $100\times10^3$ sheets, it was confirmed that the good cleaning performance can be obtained.

Embodiment 3

In this embodiment, the width W was made smaller than that in Embodiment 1, and then the transfer efficiency and the cleaning performance durability with respect to the intermediary transfer belt 8 provided with the grooves 84 of 1 μm in width W and 1 μm in depth D were checked. The intermediary transfer belt 8 having the surface layer 82 was obtained similarly as in Embodiment 1 except that the contact pressure of the lapping film when the grooves 84 were formed on the surface layer 82 of the intermediary transfer belt 8 was changed to 0.98 N/mm$^2$.

The evaluation results of the transfer efficiency and the cleaning performance durability are shown in Table 1 appearing hereinafter. Similarly as in Embodiment 1, a good transfer property of 97.2% in transfer efficiency was obtained, and even after the passing of $100\times10^3$ sheets, it was confirmed that the good cleaning performance can be obtained.

Embodiment 4

In this embodiment, the width W was made larger than that in Embodiment 1, and then the transfer efficiency and the cleaning performance durability with respect to the intermediary transfer belt 8 provided with the grooves 84 of 2.5 μm in width W and 1 μm in depth D were checked. The intermediary transfer belt 8 having the surface layer 82 was obtained similarly as in Embodiment 1 except that the contact pressure of the lapping film when the grooves 84 were formed on the surface layer 82 of the intermediary transfer belt 8 was changed to 3.92 N/mm$^2$.

The evaluation results of the transfer efficiency and the cleaning performance durability are shown in Table 1 appearing hereinafter. Similarly as in Embodiment 1, a good transfer property of 94.8% in transfer efficiency was obtained, and even after the passing of $100\times10^3$ sheets, it was confirmed that the good cleaning performance can be obtained.

Embodiment 5

In this embodiment, the width W and the depth D were made larger than that in Embodiment 1, and then the transfer efficiency and the cleaning performance durability with respect to the intermediary transfer belt 8 provided with the grooves 84 of 2.5 μm in width W and 2 μm in depth D were checked. The intermediary transfer belt 8 having the surface layer 82 was obtained similarly as in Embodiment 1 except that the abrasive grain diameter of the lapping film when the grooves 84 were formed on the surface layer 82 of the intermediary transfer belt 8 was changed to 12 μm.

The evaluation results of the transfer efficiency and the cleaning performance durability are shown in Table 1 appearing hereinafter. Similarly as in Embodiment 1, a good transfer property of 94.3% in transfer efficiency was obtained, and even after the passing of $100\times10^3$ sheets, it was confirmed that the good cleaning performance can be obtained.

Comparison Example 1

In this comparison example, the transfer efficiency and the cleaning performance durability with respect to the intermediary transfer belt 8 in which the grooves 84 were not formed on the surface layer 82 were checked. The intermediary transfer belt 8 having the surface layer 82 was obtained similarly as in Embodiment 1 except that the grooves 84 by the lapping were not formed after the surface layer 82 of the intermediary transfer belt 8 was formed.

The evaluation results of the transfer efficiency and the cleaning performance durability are shown in Table 1 appearing hereinafter. In the transfer efficiency evaluation, a good transfer property of 97.2% in transfer efficiency was obtained. On the other hand, in the cleaning performance durability evaluation, after the passing of $100\times10^3$ sheets, the defective cleaning arose, so that the good cleaning performance was not able to be satisfied.

Comparison Example 2

In this comparison example, the grooves 84 were made further smaller than those in Embodiment 3, and then the transfer efficiency and the cleaning performance durability with respect to the intermediary transfer belt 8 in which the grooves 84 of 0.5 μm in width W and 0.3 μm in depth D were checked. The intermediary transfer belt 8 having the surface layer 82 was obtained similarly as in Embodiment 1 except that the abrasive grain diameter of the lapping film when the grooves 84 were formed on the surface layer 82 of the intermediary transfer belt 8 was changed to 5 μm.

The evaluation results of the transfer efficiency and the cleaning performance durability are shown in Table 1 appearing hereinafter. In the transfer efficiency evaluation, a good transfer property of 96.7% in transfer efficiency was obtained. On the other hand, in the cleaning performance durability evaluation, after the passing of $100\times10^3$ sheets, the defective cleaning generated, so that the good cleaning performance was not able to be satisfied.

Comparison Example 3

In this comparison example, the grooves 84 were made further larger than that in Embodiment 5, and then the transfer efficiency and the cleaning performance durability with respect to the intermediary transfer belt 8 provided with the grooves 84 of 4 μm in width W and 2.5 μm in depth D were checked. The intermediary transfer belt 8 having the surface layer 82 was obtained similarly as in Embodiment 1 except that the abrasive grain diameter and the time of contact of the lapping film with the intermediary transfer belt 8 when the grooves 84 were formed on the surface layer 82 of the intermediary transfer belt 8 were changed to 12 μm and 80 sec, respectively.

The evaluation results of the transfer efficiency and the cleaning performance durability are shown in Table 1 appearing hereinafter. In the transfer efficiency evaluation, the transfer efficiency was 91.8%, and the image defect of the visually observable level generated, so that the good transfer property was not obtained. On the other hand, in the cleaning performance durability evaluation, after the passing of $100\times10^3$ sheets, the defective cleaning generated, so that the good cleaning performance was not able to be satisfied.

Comparison Example 4

In this comparison example, the transfer efficiency and the cleaning performance durability with respect to the intermediary transfer belt 8 in which the random uneven shape was imparted to the surface layer 82 by adding a filler to the surface layer 82 were checked. The intermediary transfer belt 8 having the surface layer 82 was obtained similarly as in Comparison Example 1 except that during the preparation of the above-described UV curable resin composition, for the purpose of imparting a shape to the surface layer 82, 50 wt. parts of stylene-acrylic resin fine particles ("Fine Square", manufactured by Nippon Paint Co., Ltd.) of 1 μm in particle size were added into the resin particles of the composition.

The evaluation results of the transfer efficiency and the cleaning performance durability are shown in Table 1 appearing hereinafter. In the transfer efficiency evaluation, a good transfer property of 96.7% in transfer efficiency was obtained. On the other hand, in the cleaning performance durability evaluation, after the passing of $100\times10^3$ sheets, the defective cleaning generated, so that the good cleaning performance was not able to be satisfied.

Comparison Example 5

In this comparison example, the transfer efficiency and the cleaning performance durability with respect to the intermediary transfer belt 8 in which the random uneven shape was imparted to the surface layer 82 by adding a filler larger in particle size than in Comparison Example 4 to the surface layer 82 were checked. The intermediary transfer belt 8 having the surface layer 82 was obtained similarly as in Comparison Example 1 except that during the preparation of the above-described UV curable resin composition, for the purpose of imparting a shape to the surface layer 82, 50 wt. parts of melamine silica resin particles ("Optobeads", manufactured by Nissan Chemical Industries., Ltd.) of 2 μm in particle size were added into the resin particles of the composition.

The evaluation results of the transfer efficiency and the cleaning performance durability are shown in Table 1 appearing hereinafter. In the transfer efficiency evaluation, the transfer efficiency was 93.1%, and the image defect of the visually observable level generated, so that the good transfer property was not obtained. On the other hand, in the cleaning performance durability evaluation, after the passing of $100\times10^3$ sheets, the defective cleaning generated, so that the good cleaning performance was not able to be satisfied.

TABLE 1

| | Surface treatment | Groove width (μm) | Groove depth (μm) | Contact area ratio (%) | Average in-plane roughness (μm) | 10-point average roughness Rzjis (μm) | Transfer efficiency (%) | Cleaning performance |
|---|---|---|---|---|---|---|---|---|
| Emb. 1 | Roughened | 2 | 1 | 89.2 | 19.6 | 0.39 | 95.6 | ○ |
| Emb. 2 | Roughened | 2 | 1.5 | 88.8 | 23.5 | 0.47 | 95.2 | ○ |
| Emb. 3 | Roughened | 1 | 1 | 97.0 | 10.0 | 0.26 | 97.2 | ○ |
| Emb. 4 | Roughened | 2.5 | 1 | 85.6 | 27.4 | 0.54 | 94.8 | ○ |
| Emb. 5 | Roughened | 2.5 | 2 | 80.0 | 30.0 | 0.67 | 94.3 | ○ |
| Comp. Ex. 1 | No | | | 99.6 | 4.2 | 0.17 | 97.2 | X |
| Comp. Ex. 2 | Roughened | 0.5 | 0.3 | 98.6 | 9.8 | 0.22 | 96.7 | X |
| Comp. Ex. 3 | Roughened | 4 | 2.5 | 77.9 | 54.0 | 0.70 | 91.8 | X |
| Comp. Ex. 4 | Filler added | | | 78.2 | 10.2 | 0.55 | 96.7 | X |
| Comp. Ex. 5 | Filler added | | | 55.2 | 42.1 | 1.19 | 93.1 | X |

In order to obtain the transfer efficiency of 94% or more, from the results of Embodiment 5 and Comparison Examples 3 and 5, it is understood that there is a need that the average in-plane roughness in the area of the square of the average particle size of the toner is 30 nm or less. This would be considered because when the surface roughness in the minute region is excessively large, the toner cannot point-contact the surface layer 82. Further, in order to satisfy the cleaning performance durability, from the results of Embodiment 5 and Comparison Example 4, it is understood that there is a need that the shape of the surface layer 82 is not the random uneven shape but is such that the grooves 84 along the belt feeding direction are formed. This would be considered because in the case of the random uneven shape, the local wearing of the cleaning blade 21 is liable to generate. Further, from the results of Embodiment 5 and Comparison Examples 1 and 2, it is understood that there is a need that the average in-plane roughness in the area of the square of the average particle size of the toner is 10 nm or more. This would be considered because even when the surface roughness in the minute region is excessively small, the cleaning blade 21 and the intermediary transfer belt 8 closely contact each other excessively, so that the wearing of the cleaning blade 21 is liable to advance.

Further, from the results of Embodiment 3 and Comparison Example 2 and the results of Embodiment 5 and Comparison Example 3, the following are understood. That is, the IU-point average roughness Rzjis as measured in the direction substantially perpendicular to the belt feeding direction may preferably be 0.26 μm or more and 0.67 μm or less. This would be considered because also the surface roughness in the case where the surface layer 82 is macroscopically viewed in a broader region influences the cleaning performance durability, and when Rzjis is excessively low, the local wearing is liable to generate, and when Rzjis is excessively large, the transfer efficiency is liable to lower. Further, the contact area ratio may preferably be 80% or more and 97% or less. This would be considered that when the contact area ratio is excessively low, the frictional force is locally applied to the cleaning blade 21 to increase the wearing amount, and when the contact area ratio is excessively high, the frictional force decreasing effect does not readily exhibit. Further, the width W of the groove 84 may preferably be 2.5 μm or less. This would be considered that when the width W of the groove 84 is excessively large, the toner is buried in the groove 84, and thus not only the transfer efficiency is liable to lower but also the toner slips through the cleaning blade 21 and the defective cleaning is liable to generate. From this viewpoint, it is understood that the width W of the groove 84 may preferably be less than ½ of the average particle size of the toner. Further, the depth D of the groove 84 may preferably be 2 μm or less. In this case, a reason similar to that in the case of the width W would be considered, so that it can be said that the depth D may preferably be equal to or less than the width W.

As described above, in Embodiments described above, the smooth surface layer 82 is formed of acrylic resin or the like and is provided with the grooves 84 along the belt feeding direction. As a result, it is possible to satisfy the cleaning performance by decreasing the contact area with the cleaning blade while improving the transfer efficiency by decreasing the toner depositing force. That is, according to the Embodiments described above, at the surface of the intermediary transfer belt 8, the grooves 84 along the belt feeding direction are formed so that the average in-plane roughness in the area of the square of the average particle size of the toner is 10 μm or more and 30 nm or less. As a result, it is possible to compatibly realize improvement in transfer efficiency of the toner from the intermediary transfer belt 8 onto the transfer material P and suppression of the wearing of the cleaning blade 21.

In addition thereto, a synergistic effect can be obtained by satisfying the condition of the preferred range with respect to at least one of the 10-point average roughness Rzjis, the contact area ratio, the width W of the groove 84, and the depth D of the groove 84.

Other Embodiments

The present invention was described above based on specific embodiments, but is not limited thereto.

Figure 6:
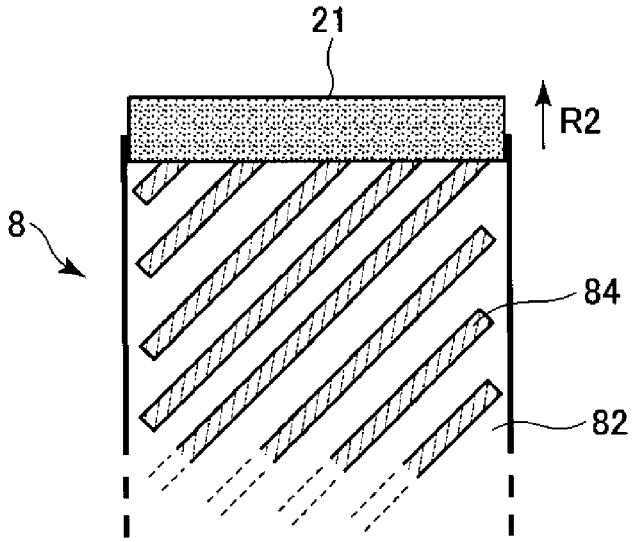
FIG. 6 is a top view of another example of the intermediary transfer belt.

For example, as shown in FIG. 6, even when the intermediary transfer belt is provided with grooves 84 which are not substantially parallel with the surface movement direction of the intermediary transfer belt but are formed with a certain angle with respect to the surface movement direction, a similar effect can be obtained. The preferred range of the angle is as described above.

Further, also with respect to the intermediary transfer belt (member) having a single layer, a similar effect can be obtained by forming the grooves on the smooth surface in accordance with the present invention. That is, the layer structure of the intermediary transfer member is not limited to that of the plurality of the layers but may also be that of the single layer. In that case, the single layer may only be required to have the same shape as that of the surface layer in the Embodiments described above. Further, even in the layer structure consisting of the plurality of the layers in the intermediary transfer member, the layer structure is not limited to the two-layer structure, but a plurality of layers each corresponding to the base layer in the Embodiments may also be provided, or a single layer or plurality of layers are formed under the layer corresponding to the base layer in the Embodiments.

Further, the intermediary transfer member is not limited to the intermediary transfer member having the belt shape, but may also be the intermediary transfer member having a drum shape (i.e., intermediary transfer drum). In that case, a similar effect can be obtained by similarly applying the present invention thereto.

Further, the image forming apparatus is not limited to the image forming apparatus of the in-line type. For example, the image forming apparatus may also be an image forming apparatus of a type in which a plurality of developing devices are provided for a single photosensitive member and toner images successively formed on the photosensitive member are primary-transferred successively onto the intermediary transfer member and then the toner images superposed on the intermediary transfer member are secondary-transferred onto the transfer material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 267858/2013 filed Dec. 25, 2013, which is hereby incorporated by reference.

What is claimed is:

1. An image forming apparatus comprising:

an image bearing member for bearing a toner image;

a movable intermediary transfer member onto which the toner image is to be transferred from said image bearing member; and a cleaning member, contacting a surface of said intermediary transfer member, for scraping off toner from the surface of said intermediary transfer member, wherein a plurality of grooves are formed at the surface of said intermediary transfer member along a surface movement direction thereof, and wherein the surface of said intermediary transfer member has an average in-plane roughness of 10 nm or more and 30 nm or less in an area of a square of an average particle size of the toner.

2. An image forming apparatus according to claim 1, wherein the surface of said intermediary transfer member has a ten-point average roughness Rzjis of 0.26 μm or more and 0.67 μm or less when the ten-point average roughness Rzjis is measured along a direction substantially perpendicular to the surface movement direction of said intermediary transfer member.

3. An image forming apparatus according to claim 2, wherein within a range of said cleaning member with respect to the direction substantially perpendicular to the surface movement direction of said intermediary transfer member, a ratio of a contact area between said intermediary transfer member and said cleaning member to a total area of said intermediary transfer member is 80% or more and 97% or less.

4. An image forming apparatus according to claim 1, wherein each of the plurality of grooves has a width less than ½ of the average particle size of the toner.

5. An image forming apparatus according to claim 1, wherein a surface layer forming the surface of said intermediary transfer member is formed of a curable resin material.

6. An image forming apparatus according to claim 5, wherein the surface layer is formed of an acrylic copolymer.

7. An image forming apparatus according to claim 5, wherein the surface layer contains fluorine-containing particles.

8. An image forming apparatus according to claim 7, wherein the fluorine-containing particles are particles of polytetrafluoroethylene.

9. An image forming apparatus according to claim 1, wherein said intermediary transfer member is an endless belt.

10. An image forming apparatus according to claim 1, wherein said intermediary transfer member has a plurality of layers.

11. An image forming apparatus according to claim 8, wherein said cleaning member is a blade formed of polyurethane.

12. An image forming apparatus according to claim 11, wherein said cleaning member has a rubber hardness, according to JIS K6253, of 70 degrees or more and 80 degrees or less.

13. An image forming apparatus according to claim 1, wherein said cleaning member is counterdirectionally contacted to said intermediary transfer member.

14. An image forming apparatus according to claim 1, wherein a contact pressure of said cleaning member with said intermediary transfer member is 0.4 N/cm or more and 0.8 N/cm or less.

15. An image forming apparatus according to claim 11, wherein the blade includes a layer, having a lower sliding resistance than that of another portion of the blade, at a portion where the blade contacts said intermediary transfer member.

* * * * *